United States Patent [19]

Reid

[11] 4,182,255

[45] Jan. 8, 1980

[54] BELOW WATERLINE DEPLOYABLE HULL STABILIZING MEMBERS

[76] Inventor: Bruce D. Reid, 124 Pine St., Toms River, N.J. 08753

[21] Appl. No.: 880,327

[22] Filed: Feb. 22, 1978

[51] Int. Cl.[2] ..... B63B 39/06; B63B 43/04

[52] U.S. Cl. ..... 114/126

[58] Field of Search ..... 114/121, 122, 126, 123, 114/285, 283; 9/3, 1.4

[56] References Cited

U.S. PATENT DOCUMENTS

| | | | |
|---|---|---|---|
| 496,700 | 5/1893 | Samohod | 114/145 R |
| 1,709,219 | 4/1929 | Hille | 114/123 |
| 2,752,874 | 7/1956 | Held | 114/126 |
| 3,952,680 | 4/1976 | Griffin | 114/122 X |

OTHER PUBLICATIONS

Bruhn, *Analysis and Design of Flight Vehicle Structures,*- Tri-State Offset Co., Cincinnati, OH. 1965, p. C10.1.

*Primary Examiner*—Stephen G. Kunin
*Assistant Examiner*—James B. Bechtel
*Attorney, Agent, or Firm*—Clarence A. O'Brien; Harvey B. Jacobson

[57] ABSTRACT

A mount is provided for support from the side of a boat hull at a level spaced above the waterline of the hull when the latter is at rest and an elongated boom is provided having base and free ends with the base end of the boom supported in stationary position from the mount and the free end of the boom projecting outwardly from the corresponding side of the hull. A generally horizontally panel structure is supported from the free end of the boom at a level below the aforementioned waterline and the boom base end and the mount include structure removably supporting the boom from the mount. The mount and boat hull include structure for supporting the mount from the hull for limited angular displacement relative to the hull about selected vertically spaced horizontal axes extending longitudinally of the corresponding side of the boat hull.

7 Claims, 4 Drawing Figures

BELOW WATERLINE DEPLOYABLE HULL STABILIZING MEMBERS

BACKGROUND OF THE INVENTION

There are many instances when it is desirable to render a small boat hull more stable when at rest in choppy and gently rolling seas. Fisherman in particular are interested in stabilizing small fishing hulls in such waters.

Although various forms of hull stabilizing structures have been heretofore designed, most of these are specifically adapted for use in conjunction with large boat hulls and those which are adapted for use in conjunction with smaller boat hulls are not readily retractably deployable nor adapted for support from various types of boat hulls. Accordingly, a need exists for an improved stabilizing structure for small boat hulls when at rest.

Various forms of boat hulls stabilizing structures as well as other devices including some of the general structural and operational features of the instant invention are disclosed in U.S. Pat. Nos. 1,100,467, 1,184,207, 3,520,267, 3,707,936, 3,792,676, 3,844,241 and 3,952,680.

BRIEF DESCRIPTION OF THE INVENTION

The hull stabilizing members of the instant invention are adapted to be utilized in pairs and to be supported from opposite sides of small boat hulls for the purpose of stabilizing those hulls in choppy and lightly rolling seas when the hulls are at rest.

The stabilizing members each include a mount for support from the corresponding boat hull side and a boom including base and free ends with the boom base end and mount including coacting structure removably supporting the base end of the boom from the mount, the free end of the boom extending laterally outwardly from the corresponding boat hull side. The free end of the boom has a horizontal panel structure supported therefrom for disposition below the water level when the associated hull is at rest and the panel structure and boom free end portion include structure removably supporting the panel structure from the free end of the boom. In addition, the mount from which the base end of the boom is removably supported includes structure for attaching the mount to the associated boat hull side for angular displacement of the mount about selected vertically spaced horizontal axes extending longitudinally of the corresponding boat hull side. In this manner, the securement of the mount to the corresponding boat hull side may be adjusted to vary the elevation of the free end of the associated boom and the corresponding horizontal stabilizing panel structure supported therefrom.

The main object of this invention is to provide a hull stabilizing structure for small boat hulls.

Another object of this invention is to provide a hull stabilizing structure utilizing a lightweight boom including a pair of elongated longitudinally extending structural members convergent toward the free end of the boom and having a rigid web portion extending and secured between the adjacent portions of the elongated structural members.

Still another object of this invention is to provide a boat hull stabilizer including a boom which may be readily removably supported from the associated boat hull.

A further object of this invention is to provide a small boat hull stabilizing structure which does not require the use of large volume flotation members.

Another very important object of this invention is to provide a boat hull stabilizing structure which may be readily manufactured in different sizes so as to be adaptable for use on different size hulls.

Still another object of this invention is to provide a boat hull stabilizer requiring no adjustment after initial installation of the stabilizer structure.

A final object of this invention to be specifically enumerated herein is to provide a boat hull stabilizing structure in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts through out.

DETAILED DESCRIPTION OF THE INVENTION

Figure 1:
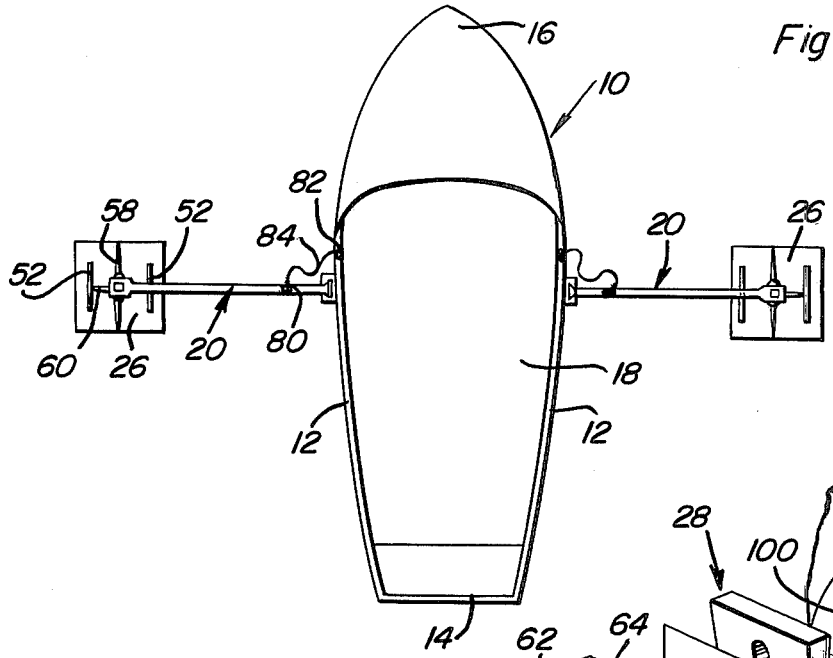
FIG. 1 is a top plan view of a conventional form of small boat hull with a pair of the boat hull stabilizing structures of the instant invention operatively associated therewith.
Figure 4:
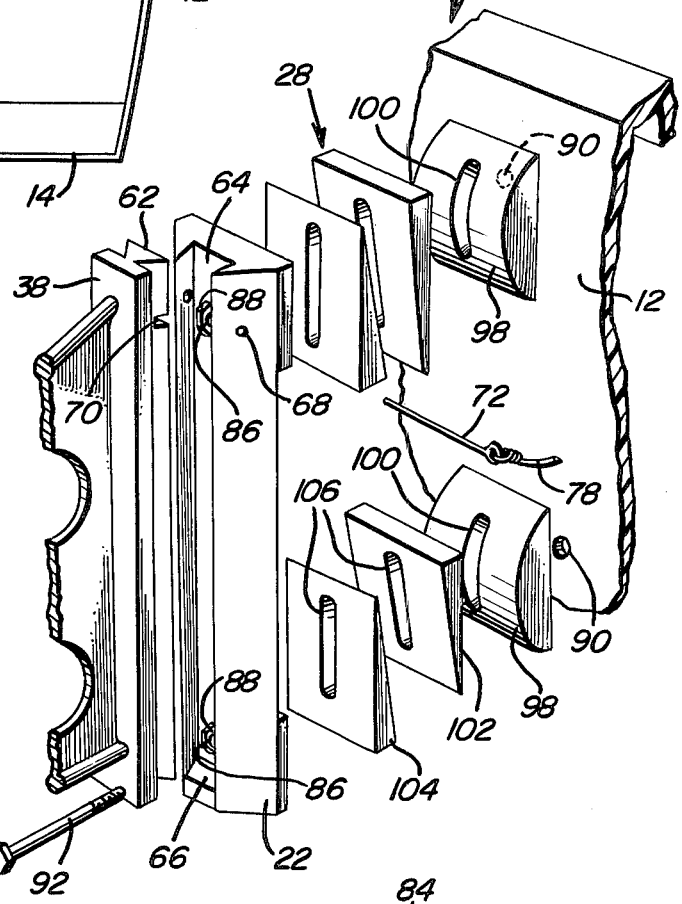
FIG. 4 is a fragmentary, exploded, perspective view of the mounting portion of one of the stabilizing structures illustrated in FIG. 1.
Figure 2:
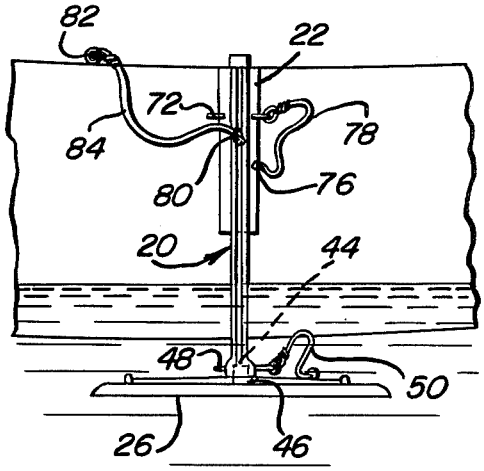
FIG. 2 is an enlarged, fragmentary, side, elevational view of the left side of the assemblage illustrated in FIG. 1.

Referring now more specifically to the drawings, the numeral 10 generally designates a conventional form of small boat hull including longitudinally extending opposite sides 12 interconnected at their rear ends by means of a transom 14 and curving inwardly toward each other at their forward ends to define a bow 16. The lower marginal edges of the sides 12 and transom 14 are interconnected by means of a bottom structure 18 extending and secured therebetween and curving upwardly at its forward end toward and merging into the bow 16.

Figure 3:
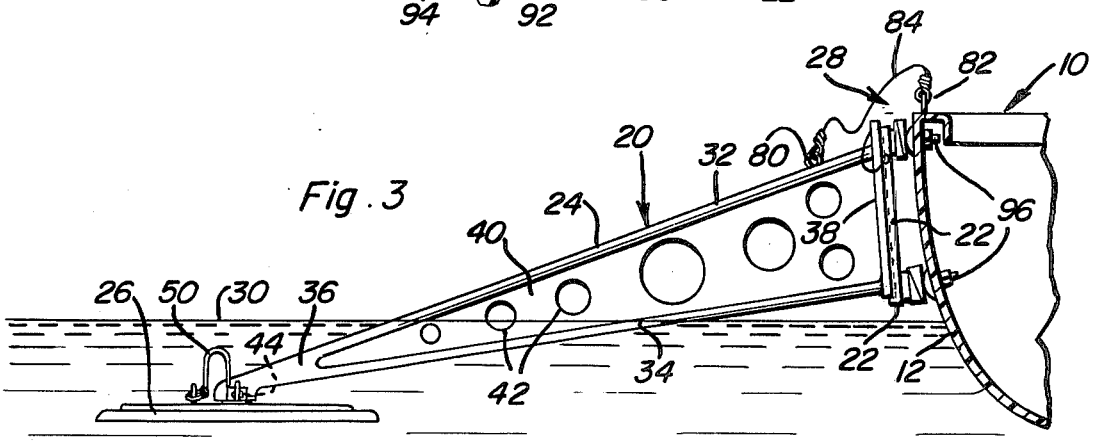
FIG. 3 is an enlarged, fragmentary, vertical, sectional view illustrating the manner in which one of the hull stabilizing structures if supported from and positioned relative to the associated boat hull and the waterline of the hull when the hull is at rest.

Referring now more specifically to FIG. 3 of the drawings, a single boat hull stabilizing structure constructed in accordance with the present invention is generally designated by the reference numeral 20. The structure 20 includes a mount 22, an elongated boom 24 and a generally horizontal panel structure 26 supported from the end of the boom 24 remote from the mount 22. In addition, mounting structure referred to in general by the reference numeral 28 is provided and is utilized to support the mount 22 from the associated side 12 of the hull 10 above the waterline 30 of the hull 10 when the latter is at rest.

From FIG. 3 of the drawings, it may also be seen that the boom 24 includes a pair of elongated and generally straight upper and lower structural members 32 and 34 convergent toward and joined together at the free end 36 of the boom 24. The divergent ends of the structural members 32 are joined together by means of an upstanding structural member 38 extending and secured between the structural members 32 and 34 and a web 40 extends between and interconnects the spaced portions of the structural members 32 and 34 and is also abutted against and secured to the upstanding structural member 38, the web 40 including openings 42 formed therethrough to reduce the weight of the boom 24. The free end portion 36 of the boom 24 defines a downwardly opening socket 44 in which an upwardly projecting shank 46 supported from the panel structure 26 is telescopingly received and a locking pin 48 is secured transversely through those portions of the free end 36 defining the socket 44 and the shank 46. The pin 48 is tethered to the panel structure 26 by means of a tether line 50 and the upper surface of the panel structure 26 includes upstanding reinforcing ribs 52 and 58 as well as reinforcing ribs 60. The reinforcing ribs 58 and 60 extend generally radially of the shank 46 and are abutted against and formed integrally with the latter for reinforcement thereof.

The upstanding structural member 38 defines a dovetail spline 62 and the mount 22 defines a dovetail slot 64 in which the spline 62 is slidingly receivable from above, the slot 64 being closed at its lower end as at 66. Accordingly, the upright structural member 38 may be removably engaged from the mount 22 by downward sliding movement of the spline 62 within the slot 64 until the spline 62 abuts against the lower end 66 of the slot 64. In addition, those portions of the mount 22 defining opposite side portions of the upper end of the slot 64 include aligned transverse bores 68 formed therein and the upper end of the spline 62 includes a transverse slot 70 registered with the bores 68 when the spline 62 is seated in the lower end of the slot 64. A latch pin 72 is removably inserted through the bores 68 and slot 70 and is tethered to the mount 22 at 76 by means of an elongated flexible tether member 78. In addition, the boom 24 includes an eye 80 supported therefrom and the side 12 includes an eye 82 supported therefrom. An elongated flexible tether member 84 has its opposite ends anchored relative to the eyes 80 and 82.

The upper and lower vertically slotted portions of the mount 22 include horizontal bores 86 secured therethrough including hexagonal counterbores 88 and the side 12 includes similarly spaced bores 90. Elongated bolts 92 having hexagonal heads 94 seated in the counterbores 88 extend through the bores 86 and the bores 90 and are secured therethrough by means of threaded nuts 96. However, a pair of slotted rocker blocks 98 overlie the outer surface of the side 12 with the slot 100 thereof registered with the bores 90 and pairs of oppositely tapering slotted wedges 102 and 104 are spaced between each rocker block 98 and the corresponding end of the mount 22. The slots 106 formed in each pair of wedges 102 and 104 are registered with each other and with the slot 100 with the corresponding bolt 92 extending through the corresponding slots 100 and 106 as well as the bores 86 and 90. By variably shifting the wedges 102 and 104 of each pair of wedges relative to each other and then tightening the corresponding nut 96 on the associated bolt 92, the mount 22 may be adjustably angularly rocked about the other rocker block 98. Accordingly, upon adjustment of both pairs of wedges 102 and 104, the elevation of the outer free end 36 of the boom 24 may be adjusted relative to the hull 10 and the waterline 30 in order to insure that the plate structure 26 is spaced sufficiently below the water level 30. In addition, the mounting structure 28 comprising the rocker blocks 98 and the wedges 102 and 104 enables the stabilizing structure 20 to be readily adjusted for use in conjunction with different types of hulls.

Various materials may be utilized in the construction of the stabilizing structures 20. However, with small boat hulls it has been found that all of the components of the structures 20, except for possibly the bolts 92, may be constructed of noncorrosive plastic material. In addition, and especially when the stabilizing structures 20 are to be utilized in conjunction with larger hulls and are thus to be constructed in larger sizes, the stabilizing structures 20 may be constructed of corrosion resistant metals.

The slot 70 and the slight deformability of the spline 62 and those portions of the mount 22 defining the slot 60 enable the spline 62 to "pull" horizontally outwardly of the slot 60 in the event excessive forces are directed on the panel structure 26 without damaging either the spline 62, the mount 22 and the pin 72.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a boat hull including opposite sides and a predetermined waterline at rest, selectively deployable hull stabilizing structure for stabilizing the hull when at rest, said stabilizing structure including an elongated upstanding mount, support means supporting vertically spaced opposite end portions of said mount from the exterior of one of said sides and for independent adjustable spacing of said end portions outwardly of said one side, said mount defining a first vertically elongated guide and support member, an elongated generally horizontal boom having base and free end, said base end of said boom including a second vertically elongated guide and support member, said first and second guide and support members including coacting removably guidingly engageable portions engageable with each other upon downward movement of said second support member relative to said first support member for stationary support of said second support member relative to said first support member with said boom projecting outward from said one side of said hull, and a generally horizontal panel structure supported from the free end of said boom at a level below said waterline.

2. The combination of claim 1 wherein said support means includes through-the-side attaching fasteners, slotted rocker blocks mounted on the exterior of said one side and longitudinally slotted and shiftable spacer wedges disposed between said blocks and said first guide and support member, said wedges being disposed between said blocks and the opposing surface of said first vertically elongated guide and support member, said fasteners being secured through said slotted wedges and said blocks.

3. The combination of claim 1 wherein said coacting portions also include means releasably locking said second member against upward displacement relative to said first member.

4. The combination of claim 1 wherein said panel structure and said free end of said boom include releasable connecting means releasably supporting said panel structure from said free end.

5. The combination of claim 4 wherein said releasable connecting means includes means releasably connecting said panel structure from said free end with the latter generally centered relative to the plan area of said panel structure.

6. The combination of claim 1 wherein said boom includes a pair of main elongated structural members convergent toward said free end and interconnected by a web portion extending and secured therebetween, said web portion defining transverse openings therein intermediate said elongated structural members and spaced longitudinally of said boom.

7. The combination of claim 6 wherein the base end of said boom includes a transverse structural member extending between and rigidly connecting the divergent ends of said main structural members, defining said second guide and support member, said coacting portions including dovetail spline and groove defining means removably slidingly engaged with each other removably supporting said transverse structural member from said mount.

* * * * *